US011348532B2

(12) United States Patent
Pyun et al.

(10) Patent No.: US 11,348,532 B2
(45) Date of Patent: May 31, 2022

(54) DISPLAY DEVICE FOR COMPENSATING DATA SIGNALS BASED ON THEIR DISTANCE FROM DISPLAY DRIVERS

(71) Applicant: Samsung Display Co., Ltd., Yongin-Si (KR)

(72) Inventors: Ki Hyun Pyun, Yongin-si (KR); Young Soo Sohn, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/858,441

(22) Filed: Apr. 24, 2020

(65) Prior Publication Data

US 2021/0125563 A1 Apr. 29, 2021

(30) Foreign Application Priority Data

Oct. 28, 2019 (KR) ..... 10-2019-0134732

(51) Int. Cl.
*G09G 3/3266* (2016.01)
*G09G 3/3291* (2016.01)
*G09G 3/32* (2016.01)

(52) U.S. Cl.
CPC ..... *G09G 3/3266* (2013.01); *G09G 3/3291* (2013.01); *G09G 2300/0413* (2013.01); *G09G 2310/08* (2013.01)

(58) Field of Classification Search
CPC ... G09G 3/3688; G09G 3/3291; G09G 3/3266
See application file for complete search history.

(56) References Cited

U.S. PATENT DOCUMENTS

| | | | | |
|---|---|---|---|---|
| 9,959,835 | B2 | 5/2018 | Baek et al. | |
| 10,423,288 | B2 | 9/2019 | Lee et al. | |
| 2007/0159441 | A1* | 7/2007 | Yang | G09G 3/3677 345/99 |
| 2014/0192097 | A1* | 7/2014 | Baek | G09G 3/3688 345/690 |
| 2018/0336816 | A1* | 11/2018 | Shin | G09G 3/3688 |
| 2019/0121208 | A1 | 4/2019 | Iwata et al. | |
| 2019/0129601 | A1 | 5/2019 | Bae et al. | |
| 2019/0295474 | A1* | 9/2019 | Kim | G09G 3/3688 |
| 2019/0392773 | A1* | 12/2019 | Higuchi | G02F 1/136286 |
| 2020/0168175 | A1* | 5/2020 | Tsuchi | G09G 3/2096 |

FOREIGN PATENT DOCUMENTS

| | | | |
|---|---|---|---|
| KR | 10-2014-0090761 | A | 7/2014 |
| KR | 10-2017-0047480 | A | 5/2017 |
| KR | 10-2017-0118286 | A | 10/2017 |

* cited by examiner

*Primary Examiner* — Sepehr Azari
(74) *Attorney, Agent, or Firm* — Innovation Counsel LLP

(57) ABSTRACT

The display device includes a first pixel connected to a first scan line and a first data line, a second pixel connected to a second scan line and the first data line, a scan driver configured to supply a scan signal to the first scan line and the second scan line, and a data driver connected to the first data line. The data driver provides a first data signal to the first pixel when the scan signal is applied to the first scan line, the data driver provides a second data signal to the second pixel when the scan signal is applied to the second scan line, and a length of a first period in which the first data signal is provided is different from a length of a second period in which the second data signal is provided.

18 Claims, 12 Drawing Sheets

FIG. 7

| HBC4 ($2^4$T) | HBC3 ($2^3$T) | HBC2 ($2^2$T) | HBC1 ($2^1$T) | HBP OUTPUT (T) |
|---|---|---|---|---|
| 0 | 0 | 0 | 0 | 30T |
| 0 | 0 | 0 | 1 | 32T |
| 0 | 0 | 1 | 0 | 34T |
| ⋮ | | | | |
| 1 | 1 | 0 | 1 | 56T |
| 1 | 1 | 1 | 0 | 58T |
| 1 | 1 | 1 | 1 | 60T |

FIG. 13

| DMC4 ($2^5$T) | DMC3 ($2^4$T) | DMC2 ($2^3$T) | DMC1 ($2^2$T) | DMP OUTPUT (T) |
|---|---|---|---|---|
| 0 | 0 | 0 | 0 | 0T |
| 0 | 0 | 0 | 1 | 4T |
| 0 | 0 | 1 | 0 | 8T |
| ⋮ | | | | |
| 1 | 1 | 0 | 1 | 52T |
| 1 | 1 | 1 | 0 | 56T |
| 1 | 1 | 1 | 1 | 60T |

DISPLAY DEVICE FOR COMPENSATING DATA SIGNALS BASED ON THEIR DISTANCE FROM DISPLAY DRIVERS

This application claims priority to and the benefit of Korean Patent Application No. 10-2019-0134732, filed on Oct. 28, 2019, the disclosure of the Korean Patent Application incorporated herein in its entirety by reference.

BACKGROUND

1. Field

The technical field relates to a display device.

2. Description of the Related Art

Display devices, which are connection mediums between users and information, are becoming even more important as information technology develops. Accordingly, use of display devices such as liquid crystal display devices or organic light emitting display devices has been increasing.

A display device includes a display unit and a driver. The display unit includes a plurality of pixels. The driver includes a scan driver that supplies a scan signal to the pixels and a data driver that supplies a data voltage to the pixels. The data driver generates data signals of an analog format based on image data and control data of a digital format input from a timing controller.

The pixels may be charged based on the supplied data voltage. Based on a distance between the pixels and the driver, charge rates of the pixels may be different from each other. When the charge rate of some pixels is insufficient, the display unit may not display a desired image and noise may occur on the display screen.

SUMMARY

An object of the disclosure is to provide a display device capable of compensating for a charge rate of pixels by adjusting a supply period of a data signal supplied to the pixels according to a distance of the pixels from the data driver.

In addition, another object of the disclosure is to provide a display device capable of adjusting a period in which a data signal is supplied for each driver circuit included in a data driver according to a distance of pixels from a scan driver.

The objects of the disclosure are not limited to the above-described objects, and other technical objects that are not described above will be clearly understood by those skilled in the art from the following description.

A display device according to an embodiment of the disclosure for resolving the above-described object includes a first pixel connected to a first scan line and a first data line, a second pixel connected to a second scan line and the first data line, a scan driver configured to supply a scan signal to the first scan line and the second scan line, and a data driver connected to the first data line. The data driver provides a first data signal to the first pixel when the scan signal is applied to the first scan line, the data driver provides a second data signal to the second pixel when the scan signal is applied to the second scan line, and a length of a first period in which the first data signal is provided is different from a length of a second period in which the second data signal is provided.

The second scan line may be positioned between the first scan line and the data driver, and the length of the first period may be longer than the length of the second period.

The display device may further include a timing controller configured to provide a data control signal to the data driver, the data control signal may include line image data respectively corresponding to the first scan line and the second scan line, and each of the line image data may include line start data, setting control data, pixel data, and horizontal blank period data.

The setting control data may include blank control data for controlling a period in which the horizontal blank period data is supplied to the data driver.

First line image data corresponding to the first pixel may include first horizontal blank period data, second line image data corresponding to the second pixel may include second horizontal blank period data, and a period in which the first horizontal blank period data is supplied may be set to be longer than a period in which the second horizontal blank period data is supplied.

A period in which the line image data is supplied to the data driver may increase as a period in which the horizontal blank period data is supplied to the data driver increases.

Each of the line image data may further include dummy data, and the dummy data may be provided between the pixel data and the horizontal blank period data.

The setting control data may include dummy control data for controlling a period in which the dummy data is supplied to the data driver.

First line image data corresponding to the first pixel may include first dummy data, second line image data corresponding to the second pixel may include second dummy data, and a period in which the first dummy data is supplied may be longer than a period in which the second dummy data is supplied.

A period in which the line image data is supplied to the data driver may increase as a period in which the dummy data is supplied to the data driver increases.

The display device may further include a third pixel connected to the first scan line and a second data line, the second data line may be positioned between the first data line and the scan driver, the data driver may provide a third data signal to the third pixel through the second data line, and a length of a third period in which the third data signal is provided may be shorter than the length of the first period.

The display device may further include a fourth pixel connected to the second scan line and the second data line, the data driver may provide a fourth data signal to the fourth pixel through the second data line, and a length of a fourth period in which the fourth data signal is provided may be longer than the length of the second period.

The length of the third period may be longer than the length of the fourth period.

The data driver may include a plurality of driver circuits, and the first data line and the second data line may be connected to different driver circuits.

A display device according to an embodiment of the disclosure for resolving the above-described object includes a scan driver including scan lines, a data driver including data lines, and pixels connected to respective ones of the scan lines and respective ones of the data lines. The data driver provides data signals to the pixels through respective ones of the data lines, and a period in which the data signal is supplied to the pixels increases as a distance from the data driver increases.

The display device may further include a timing controller configured to provide a data control signal to the data driver, the data control signal may include line image data respectively corresponding to the scan lines, and each of the line image data may include line start data, setting control data, pixel data, and horizontal blank period data.

The setting control data may include blank control data for controlling a period in which the horizontal blank period data is supplied to the data driver.

A period in which the line image data is supplied may increase as a period in which the horizontal blank period data is supplied increases.

Each of the line image data may further include dummy data, the dummy data may be provided between the pixel data and the horizontal blank period data, and the setting control data may include dummy control data for controlling a period in which the dummy data is supplied to the data driver.

A period in which the line image data is supplied may increase as a period in which the dummy data is supplied increases.

Specific details of other embodiments are included in the detailed description and drawings.

The display device according to the disclosure may compensate for a charge rate of the pixels by adjusting a supply period of the data signal supplied to the pixels according to the distance of the pixels from the data driver. Therefore, the display device may reduce noise occurrence of the display device and improve display quality.

In addition, the display device according to the disclosure may adjust a period in which the data signal is supplied for each driver circuit included in the data driver according to the distance of the pixels from the scan driver.

The effect according to the embodiments is not limited by the details illustrated above, more various effects are included in the present specification.

BRIEF DESCRIPTION OF THE DRAWINGS

The above and other features of the disclosure will become more apparent by describing in further detail embodiments thereof with reference to the accompanying drawings, in which:

FIG. 7 is a diagram illustrating an output period of horizontal blank period data according to blank control data of FIG. 6;

FIG. 13 is a diagram illustrating an output period of dummy data according to dummy control data of FIG. 12.

DETAILED DESCRIPTION OF THE EMBODIMENT

Figure 1:
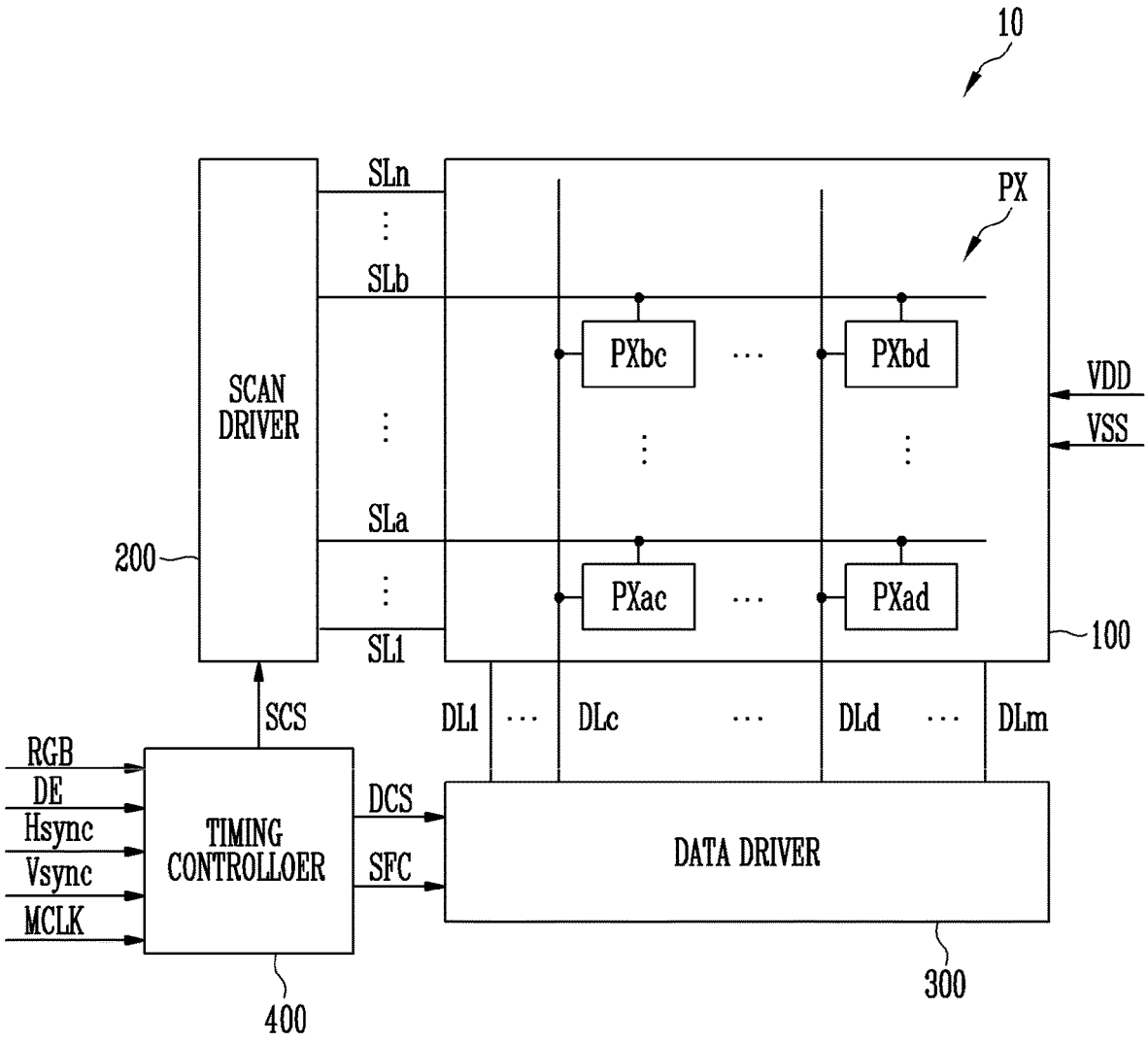
FIG. 1 is a diagram illustrating a display device according to an embodiment of the disclosure.

The advantages and features of the disclosure and a method of achieving them will become apparent with reference to the embodiments described in detail below together with the accompanying drawings. However, the disclosure is not limited to the embodiments disclosed below, and may be implemented in various different forms. The present embodiments are provided so that the disclosure will be thorough and complete and those skilled in the art to which the disclosure pertains can fully understand the scope of the disclosure. The disclosure is only defined by the scope of the claims.

Example embodiments are described with reference to the accompanying drawings, wherein like reference numerals may refer to like elements.

Although the terms "first," "second," etc. may be used to describe various components, these components should not be limited by these terms. These terms are used to distinguish one component from another. A first component may be termed a second component without departing from teachings of one or more embodiments. The description of a component as a "first" component may not require or imply the presence of a second component or other components. The terms "first," "second," etc. may be used to differentiate different categories or sets of components. For conciseness, the terms "first," "second," etc. may represent "first-type (or first-set)," "second-type (or second-set)," etc., respectively.

The singular forms "a," "an," and "the" may include the plural forms as well, unless the context clearly indicates otherwise.

When a first element is referred to as being "on" a second element, the first element can be directly or indirectly on the second element. One or more intervening elements may be present between the first element and the second element.

Sizes of elements in the drawings may be exaggerated for convenience of explanation.

Hereinafter, embodiments of the disclosure will be described in detail with reference to the accompanying drawings. The same or similar reference numerals are used for the same components in the drawings.

FIG. 1 is a diagram illustrating a display device according to an embodiment of the disclosure.

Referring to FIG. 1, the display device according to an embodiment may include a display unit 100, a scan driver 200, a data driver 300, and a timing controller 400.

The display unit 100 may display an image. The display unit 100 may be implemented as a display panel. The display unit 100 may include various display elements such as an organic light emitting element (for example, an organic light emitting diode (OLED)). Hereinafter, for convenience of description, the display device 10 including the organic light emitting element as the display element may be described. In embodiments, various types of display devices such as a liquid crystal display device (LCD), an electrophoretic display device (EPD), and an inorganic light emitting display device may be included in the display unit 100.

The display unit 100 may include scan lines SL1 to SLn (where n is a positive integer, data lines DL1 to DLm (where m is a positive integer), and the pixel PX.

The scan lines SL1 to SLn may include a second scan line SLa and a third scan line SLb positioned between the first scan line SL1 and the n-th scan line SLn. The second scan line SLa may be a scan line positioned between the first scan line SL1 and the third scan line SLb, and the third scan line SLb may be a scan line positioned between the second scan line SLa and the n-th scan lines SLn.

The data lines DL1 to DLm may include a second data line DLc and a third data line DLd positioned between the first data line DL1 and the m-th data line DLm. The second data line DLc may be a data line positioned between the first data line DL1 and the third data line DLd, and the third data line DLd may be a data line positioned between the second data line DLc and the m-th data lines DLm.

The pixels PX may be connected to respective ones of the scan lines SL1 to SLn and respective ones of the data lines DL1 to DLm. The pixel PX may emit or supply light of a predetermined luminance to the outside based on the data signal transferred through the data lines DL1 to DLm.

In an embodiment, the pixel PX may be electrically connected to scan lines corresponding to adjacent rows (for example, scan lines corresponding to a previous row of a row including the pixel PX and scan lines corresponding to a subsequent row of the row including the pixel PX).

Meanwhile, the pixel PX may include a first pixel PXac, a second pixel PXbc, a third pixel PXad, and a fourth pixel PXbd. The first pixel PXac and the second pixel PXbc may be connected to the second data line DLc. The first pixel PXac may be connected to the second scan line SLa, and the second pixel PXbc may be connected to the third scan line SLb. The third pixel PXad and the fourth pixel PXbd may be connected to the third data line DLd. The third pixel PXad may be connected to the second scan line SLa, and the fourth pixel PXbd may be connected to the third scan line SLb.

In addition, the pixel PX may be electrically connected to a first power line and a second power line to receive voltages of first power VDD and second power VSS. Here, the first power VDD and the second power VSS may be power to drive the pixel PX and drivers 200, 300, and 400. The first power VDD may supply a voltage of a high level, and the second power VSS may supply a voltage of a low level.

The scan driver 200 may generate scan signals based on a scan control signal SCS and provide the generated scan signals to the scan lines SL1 to SLn.

The scan driver 200 may include a plurality of stage circuits, and each of the stage circuits may provide the scan signals to the display unit 100 through the scan lines SL1 to SLn.

The scan signals may be scan signals including pulses of a low voltage level or pulses of a high voltage level. For example, when a transistor of the pixel PX is configured as an N-type transistor, the scan signals may include pulses of a low voltage level. In addition, when the transistor of the pixel PX is configured as a P-type transistor, the scan signals may include pulses of a high voltage level. In addition, the above-described N-type transistor may be an N-type metal oxide semiconductor (NMOS), and the above-described P-type transistor may be a P-type metal oxide semiconductor (PMOS).

The scan control signal SCS may be a signal for controlling an operation of the scan driver 200 and may include a scan start pulse (or a scan start signal) and one or more scan shift clocks. The scan start pulse may control a start timing of the scan signals, and the scan shift clock may refer to one or more clock signals for shifting the scan start pulse.

The scan driver 200 may be implemented as a shift register. The scan driver 200 may be directly formed on one region of the display unit 100 (or one region of the display panel) or may be implemented as an integrated circuit and mounted on a flexible circuit board to be connected to the display unit 100.

The data driver 300 may generate a data signal based on a data control signal DCS and a clock control signal SFC, and provide the data signal to the data lines DL1 to DLm in a pixel row unit. Here, the data control signal DCS may be include control signals for controlling an operation of the data driver 300 and image signals including image data information. The data driver 300 may include a plurality of driver circuits.

The timing controller 400 may receive input image data RGB and input control signals from the outside (for example, a processor or a scaler). The input image data RGB may include grayscale values corresponding to each pixel PX. The input control signals may include a vertical synchronization signal Vsync, a horizontal synchronization signal Hsync, a main clock signal MCLK, a data enable signal DE, and the like.

The timing controller 400 may generate the scan control signal SCS, the data control signal DCS, and the clock control signal SFC based on the input image data RGB and the input control signals. The timing controller 400 may provide the scan control signal SCS to the scan driver 200, and may provide the data control signal DCS and the clock control signal SFC to the data driver 300.

Figure 2:
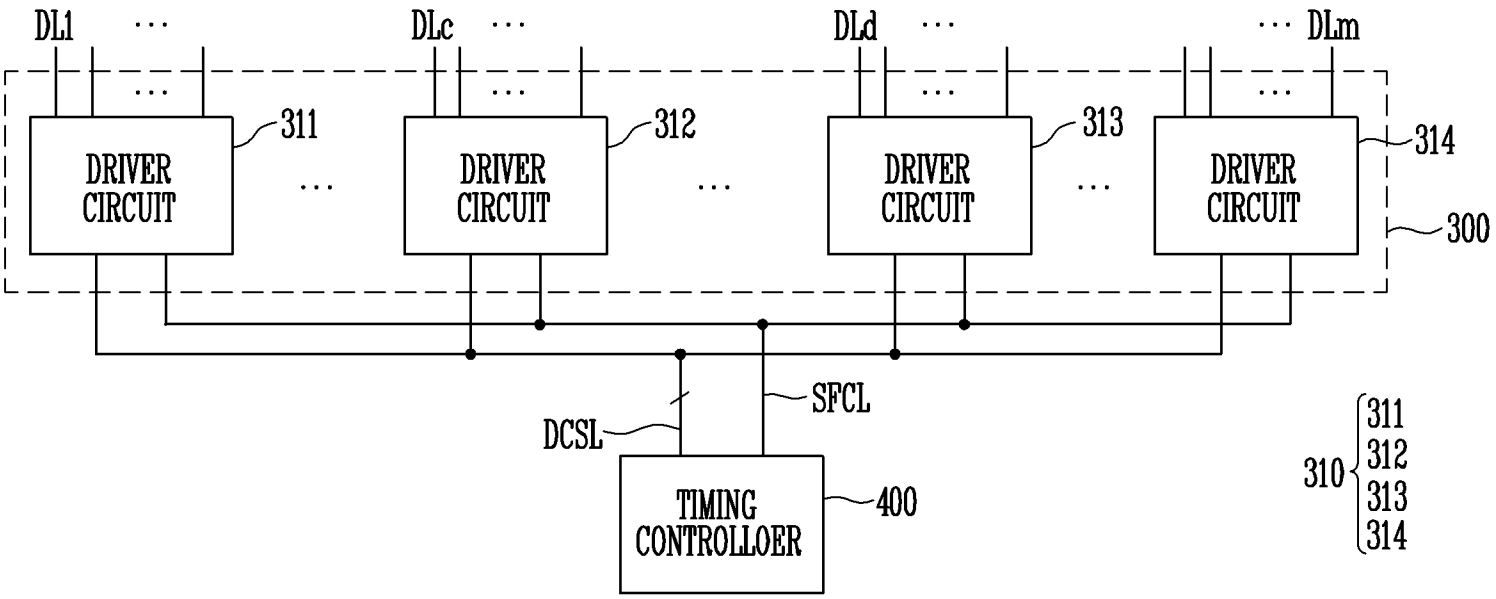
FIG. 2 is a diagram illustrating a data driver shown in FIG. 1.

FIG. 2 is a diagram illustrating the data driver shown in FIG. 1.

Referring to FIGS. 1 and 2, the data driver 300 according to an embodiment of the disclosure may include one or a plurality of driver circuits 310. When the display device 10 includes only one driver circuit 310, the driver circuit 310 and the data driver 300 may be the same. All of the data lines DL1 to DLm may then be connected to the one driver circuit 310. When the display device 10 includes the plurality of driver circuits 310, the data lines DL1 to DLm may be grouped, and each data line group may be connected to a corresponding driver circuit 310.

The driver circuits 310 may include a first driver circuit 311, a second driver circuit 312, a third driver circuit 313, and a fourth driver circuit 314. The first driver circuit 311 may be connected to a data line group including the first data line DL1 of FIG. 1, the second driver circuit 312 may be connected to a data line group including the second data line DLc, the third driver circuit 313 may be connected to a data line group including the third data line DLd, and the fourth driver circuit 314 may connect a data line group including the m-th data line DLm of FIG. 1. That is, the second data line DLc and the third data line DLd may be connected to different driver circuits 310. In an embodiment, the data lines may be connected to the same driver circuit.

The driver circuits 310 may use one clock training line SFCL as a common bus line. For example, the timing controller 400 may simultaneously transfer the clock control signal SFC for supplying a clock training pattern to all the driver circuits 310 through the one clock training line SFCL.

The driver circuit 310 may be connected to the timing controller 400 through a dedicated data control line DCSL. For example, when the display device 10 includes the plurality of driver circuits 310, the driver circuits 310 may each be connected to the timing controller 400 through the data control line DCSL.

At least one data control line DCSL of the driver circuit 310 may be provided. For example, when a bandwidth of the one data control line DCSL is insufficient, a plurality of data control lines DCSL may be connected each driver circuits 310 to supplement the insufficient bandwidth. In addition, even in a case where the data control line DCSL is configured as a differential signal line to remove common mode noise, each driver circuit 310 may be connected with a plurality of data control lines DCSL.

The driver circuit 310 may generate the data signal based on the data control signal DCS supplied through the data control line DCSL and provide the data signal to the data lines DL1 to DLm in a pixel row unit. Periods in which one driver circuit 310 supplies the data signal for each pixel row may be set differently from each other. For example, a period in which the data signal is supplied to a pixel row that is relatively close to the driver circuit 310 may be set to be short. A period in which the data signal is supplied to a pixel row that is relatively far from the driver circuit 310 may be set to be long. In addition, even though the data signal is supplied to the same pixel row, periods in which the data signal is supplied from each of the driver circuits 310 may be different from each other. The period in which the driver circuit 310 supplies the data signal may be set as necessary, and the timing controller 400 may provide the data control signal DCS including data for controlling a data signal supply period to each driver circuit 310.

Figure 3A:
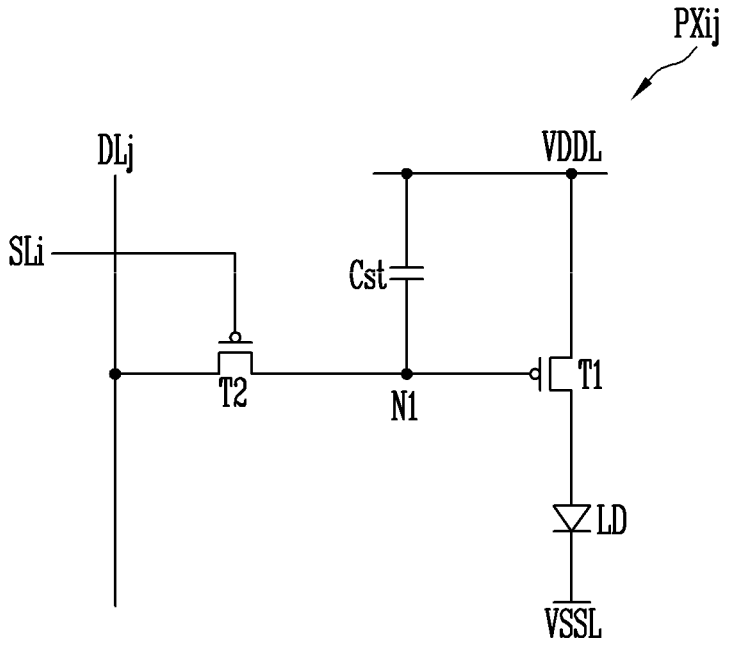
FIG. 3A is a diagram illustrating a pixel according to an embodiment of the disclosure.
Figure 3B:
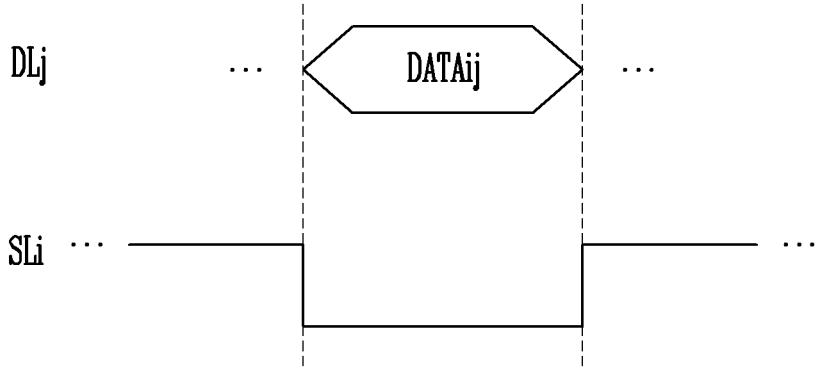
FIG. 3B is a diagram illustrating a driving method of the pixel of FIG. 3A.

FIG. 3A is a diagram illustrating a pixel according to an embodiment of the disclosure. FIG. 3B is a diagram illustrating a driving method of the pixel of FIG. 3A.

Referring to FIGS. 3A and 3B, the pixel PXij may be connected to a scan line SLi and a data line DLj. The scan line SLi may be any one of the scan lines S1 to Sn of FIG. 1, and the data line DLj may be any one of the data lines D1 to Dm of FIG. 1.

The pixel PXij may include a light emitting element LD, a plurality of transistors T1 and T2, and a storage capacitor Cst.

In an embodiment, the transistors are shown as P-type transistors, for example PMOS. In an embodiment, a pixel circuit performing the same function may include N-type transistors, for example NMOS.

A first electrode (for example, an anode electrode) of the light emitting element LD may be connected to a first power line VDDL through the first transistor T1, and a second electrode (for example, a cathode electrode) of the light emitting element LD may be connected to a second power line VSSL. The first power line VDDL may be a line providing the voltage of the first power VDD of FIG. 1, and the second power line VSSL may be a line providing the voltage of the second power VSS of FIG. 1.

A first electrode of the first transistor T1 (i.e., a driving transistor) may be connected to the first power line VDDL, and a second electrode of the first transistor T1 may be connected to the first electrode of the light emitting element LD. A gate electrode of the first transistor T1 may be connected to a first node N1. The first transistor T1 may control the amount of driving current supplied to the light emitting element LD in correspondence with a voltage of the first node N1.

A first electrode of the second transistor T2 (i.e., a switching transistor) may be connected to the data line DLj, and a second electrode of the second transistor T2 may be connected to the first node N1. A gate electrode of the second transistor T2 may be connected to the scan line SLi.

One electrode of the storage capacitor Cst may be connected to the first node N1, and another electrode may be connected to the first power line VDDL. The storage capacitor Cst may be charged with a voltage corresponding to a data signal of one frame supplied to the first node N1, and may maintain the charged voltage until the data signal of a next frame is supplied.

When a scan signal of a turn-on level (for example, a low voltage level) is supplied to the gate electrode of the second transistor T2 through the scan line SLi, the second transistor T2 may connect the data line DLj and the one electrode of the storage capacitor Cst to each other. Therefore, a voltage value according to a difference between a data voltage DATAij applied through the data line DLj and the voltage of the first power VDD of FIG. 1 of the first power line VDDL may be written to the storage capacitor Cst. As an embodiment, a period in which the scan signal is supplied through the scan line SLi may be set to be longer than a period in which the data voltage DATAij is applied. As an embodiment, the period in which the scan signal is supplied through the scan line SLi may be set to be the same as the period in which the data voltage DATAij is applied.

As a supply period of the data voltage DATAij supplied through the second transistor T2 increases, the storage capacitor Cst may have sufficient time to be charged.

The first transistor T1 may allow a driving current determined according to the voltage written to the storage capacitor Cst to flow from the first power line VDDL to the second power line VSSL. The light emitting element LD may emit light at a luminance corresponding to a driving current amount.

For convenience of description, FIG. 3A shows a pixel circuit of a relatively simple structure including the second transistor T2 for transferring the data signal into the pixel PXij, the storage capacitor Cst for storing the data signal, and the first transistor T1 for supplying the driving current corresponding to the data signal to the light emitting element LD.

In embodiments, the pixel circuit may further include various transistors such as a compensation transistor for compensating for a threshold voltage of the first transistor T1, an initialization transistor for initializing the first node N1 or the anode electrode of the light emitting element LD, and/or a light emission control transistor for controlling a light emission time of the light emitting element LD. In embodiments, the pixel circuit may have a configuration capable of detecting a characteristic of the pixel (for example, a deterioration characteristic of the first transistor T1 and/or the light emitting element LD) from the outside.

Figure 4:
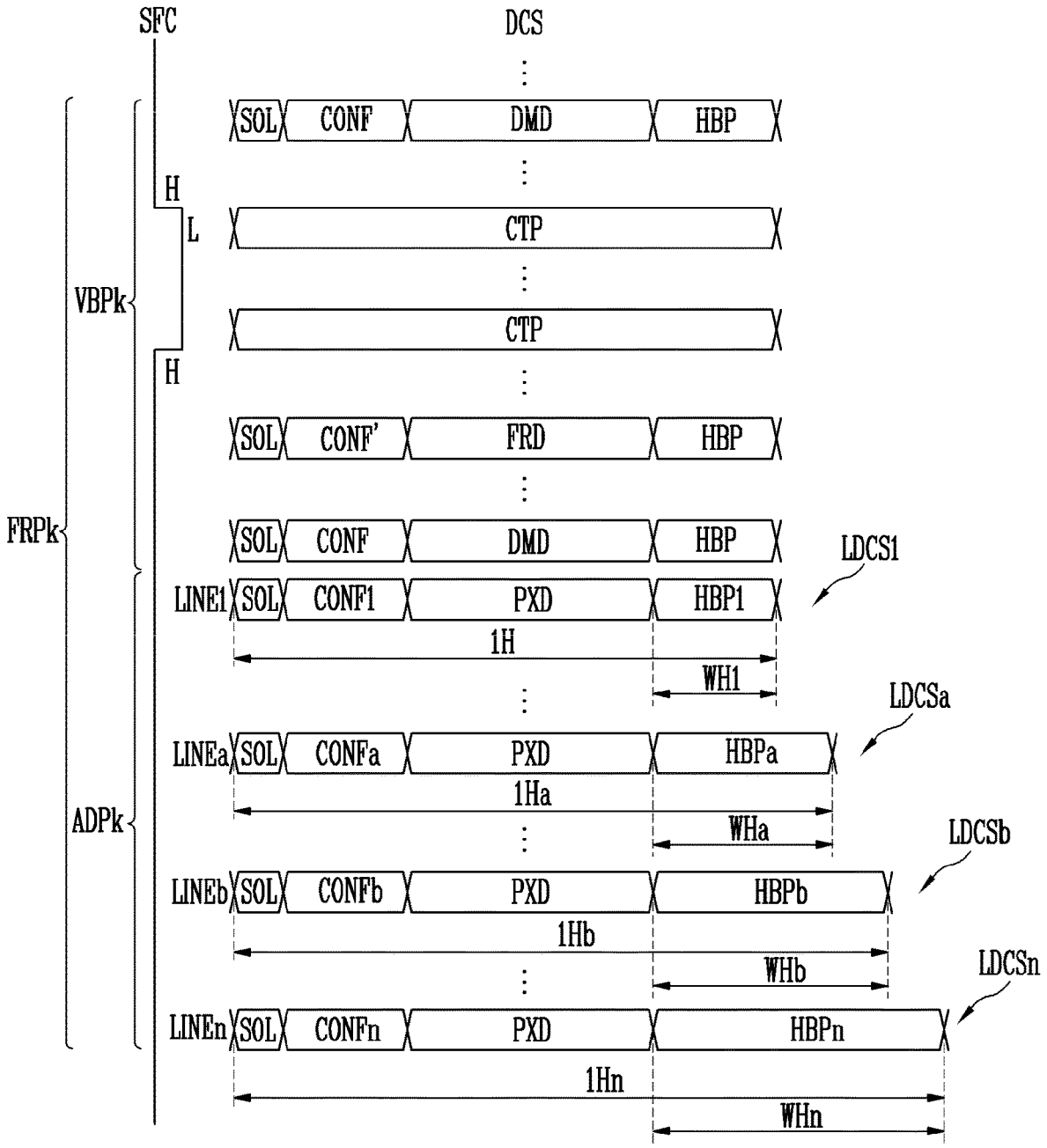
FIG. 4 is a diagram illustrating a signal provided to the data driver by a timing controller during one frame according to an embodiment of the disclosure.
Figure 5:
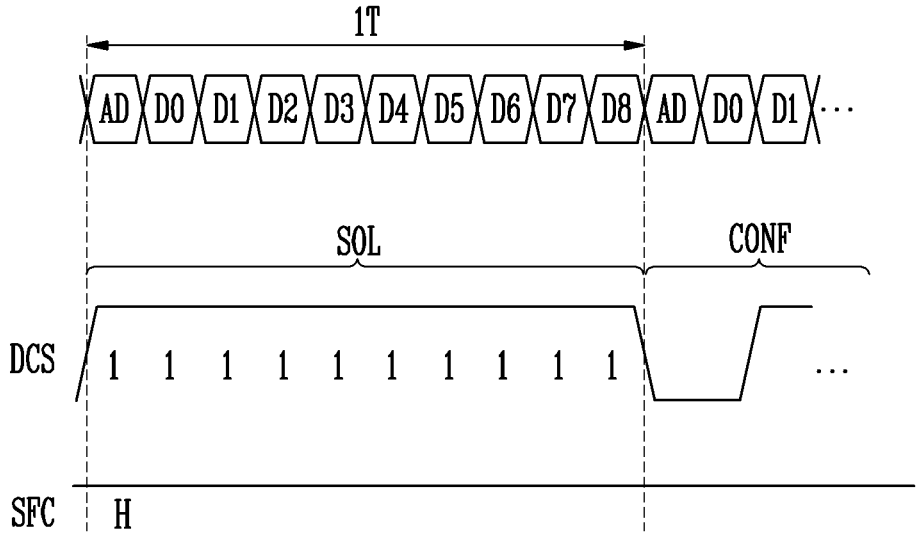
FIG. 5 is a diagram illustrating line start data of FIG. 4.
Figure 6:
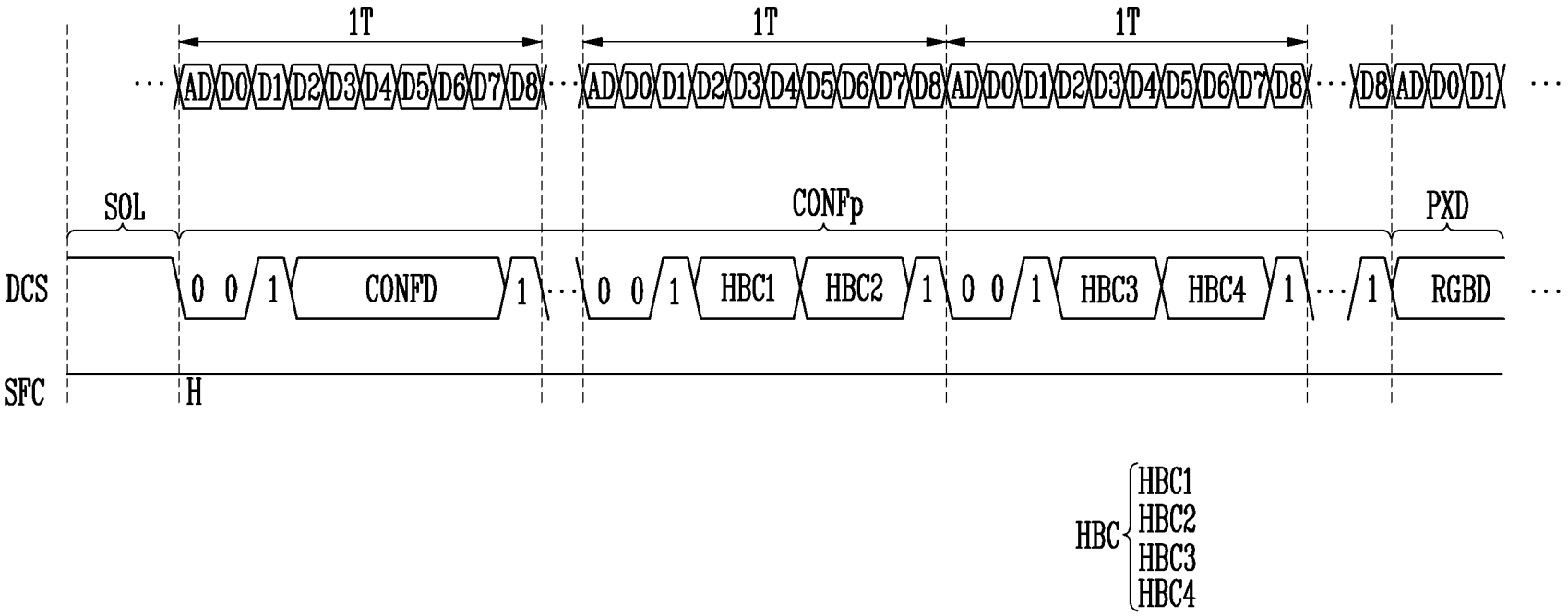
FIG. 6 is a diagram illustrating setting control data of FIG. 4.
Figure 8:
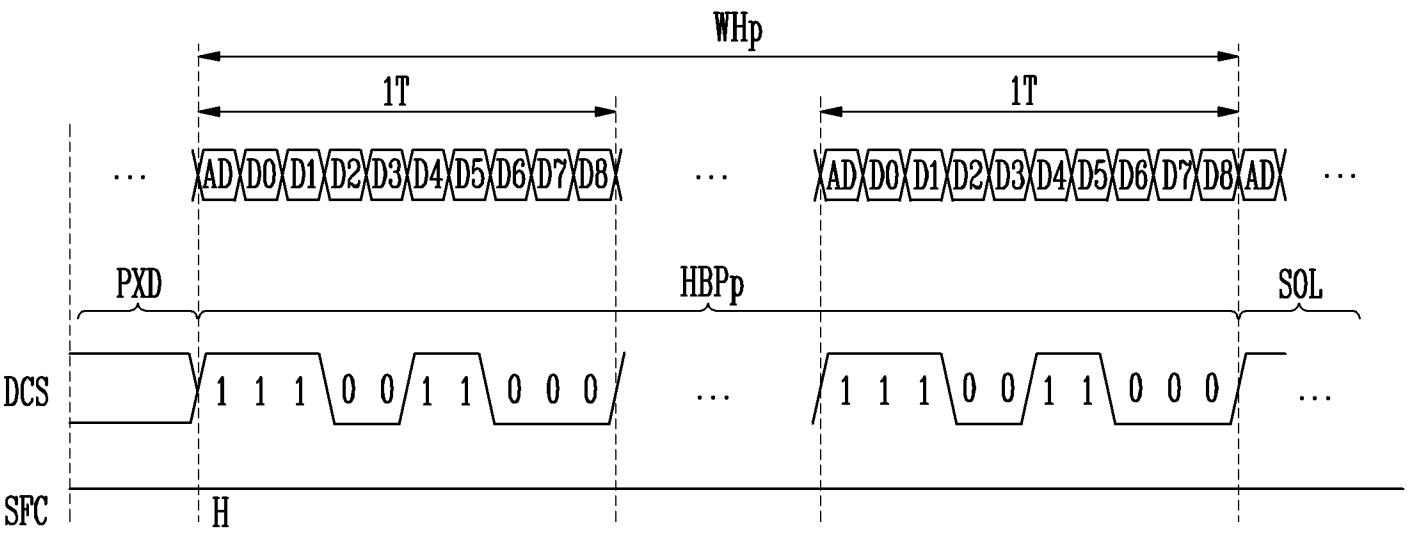
FIG. 8 is a diagram illustrating the horizontal blank period data of FIG. 4.

FIG. 4 is a diagram illustrating a signal provided to the data driver by the timing controller during one frame according to an embodiment of the disclosure. FIG. 5 is a diagram illustrating line start data of FIG. 4. FIG. 6 is a diagram illustrating setting control data of FIG. 4. FIG. 7 is a diagram illustrating an output period of horizontal blank period data according to blank control data of FIG. 6. FIG. 8 is a diagram illustrating the horizontal blank period data of FIG. 4.

Referring to FIG. 1 and FIGS. 4 to 8, the timing controller 400 may provide the data control signal DCS and the clock control signal SFC for each image frame to the data driver 300.

One image frame may refer to a unit period in which the display unit 100 displays one still image, and a moving image moving by combining a plurality of image frames may be displayed through the display device 10.

The frame period for each image frame may include a vertical blank period and an active data period. For example, a k-th frame period FRPk may include a k-th vertical blank period VBPk and a k-th active data period ADPk.

The active data period ADPk may be a supply period of grayscale values configuring an image frame to be displayed by the pixels PX of the display unit 100. The grayscale values may be included in pixel data PXD.

The vertical blank period VBPk may be positioned between the active data period of a previous frame and the active data period ADPk of a current frame. That is, in a frame period FRPk, the active data period ADPk may proceed after the vertical blank period VBPk.

Clock training, frame setting, and dummy pixel data supply may be performed during the vertical blank period VBPk. The vertical blank period VBPk may sequentially include a supply period of dummy pixel data DMD, a supply period of a clock training pattern CTP, a supply period of frame data FRD, and a supply period of the dummy pixel data DMD.

During the horizontal blank period VBPk, the timing controller 400 may provide the clock control signal SFC to the data driver 300 through the clock control line SFCL of FIG. 2. The timing controller 400 may supply the clock control signal SFC of a first level (for example, a low level L) during the vertical blank period VBPk to inform the data driver 300 that the clock training pattern CTP is supplied through the data control line DCSL. When the clock training pattern CTP is not supplied, the timing controller 400 may apply the clock control signal SFC of a second level (for example, a high level H) to the clock control line SFCL.

For example, the clock training pattern CTP may include at least one unit data, and each unit data may be include 10 bits of digital data. A period in which the unit data is supplied to the data control line DCSL may be referred to as one cycle 1T. Each unit data of the clock training pattern CTP may repeat a high level to low level ratio of 6 to 4 and 4 to 6. The clock training pattern CTP may be set to different ratios.

During the active data period ADPk, a plurality of pixel data PXD and a plurality of control data SOL, CONF, and HBP for each active line may be supplied to the data driver 300. Each active line may correspond to a pixel row corresponding to each of the scan lines SL1 to SLn.

For example, a first active line LINE1 may be a pixel row corresponding to the first scan line SL1, and the data control signal DCS supplied to the first active line LINE1 may be first line image data LDCS1. A second active line LINEa may be a pixel row corresponding to the second scan line SLa, and the data control signal DCS supplied to the second active line LINEa may be second line image data LDCSa. A third active line LINEb may be a pixel row corresponding to the third scan line SLb, and the data control signal DCS supplied to the third active line LINEb may be third line image data LDCSb. An n-th active line LINEn may be a pixel row corresponding to the n-th scan line SLn, and the data control signal DCS supplied to the n-th active line LINEn may be n-th line image data LDCSn.

The line image data LDCS1 to LDCSn supplied through the respective active lines LINE1 to LINEn may have different supply periods. The first line image data LDCS1 may be supplied during a first period 1H, the second line image data LDCSa may be supplied during a second period 1Ha, the third line image data LDCSb may be supplied during a third period 1Hb, and the n-th line image data LDCSn may be supplied during an n-th period 1Hn. In an embodiment, the supply period of the supplied line image data may be longer from the first active line LINE1 to the n-th active line LINEn. That is, the first period 1H may be the shortest, the third period 1Hb may be longer than the second period 1Ha, and the n-th period 1Hn may be the longest.

The line image data LDCS1 to LDCSn may include line start data SOL, setting control data CONF, pixel data PXD, and horizontal blank period data HBP that are sequentially provided. A supply period of the horizontal blank period data HBP may be adjusted by the setting control data CONF.

For example, first horizontal blank period data HBP1 of the first line image data LDCS1 may be adjusted by first setting control data CONF1 and supplied during a first blank period WH1. That is, the timing controller 400 may control the setting control data CONF to adjust the supply period of each line image data.

FIGS. 5, 6, and 8 respectively show line start data SOL, setting control data CONFp, and horizontal blank period data HBPp. The line start data SOL, the setting control data CONFp, and the horizontal blank period data HBPp include a plurality of unit data, and each unit data may include 10 bits AD, D0, D1, D2, D3, D4, D5, D6, D7, D8). As described above, a period in which one unit data is supplied may be referred to as one cycle 1T. Each unit data may include a transition bit AD. The transition bit AD may be set so that a level is different from that of a previous bit. In an embodiment, the transition bit AD may be set so that the level is different from that of a subsequent bit. For example, the transition bit AD may inform of a start of each unit data.

As shown in FIG. 5, the line start data SOL may inform the driver circuit 310 of FIG. 2 that a supply of a signal for a changed pixel row is started. Although a unit data column of the line start data SOL is configured as 1111111111 in the illustration, the unit data column of the line start data SOL may vary. The setting control data CONF may be provided after the line start data SOL is provided.

The setting control data CONF may include an operation option of the driver circuit 310. For example, the setting control data CONF may inform a type of subsequent data. The data subsequent to the setting control data CONF may be the pixel data PXD or the dummy pixel data DMD, and data subsequent to setting control data CONF' may be the frame data FRD.

FIG. 6 is a diagram illustrating the setting control data of FIG. 4. In particular, FIG. 6 shows an example of setting control data CONFp provided during the active data period ADPk. The setting control data CONFp may include a 10-bit unit data string starting with 001 and ending with 1, and may include operation option data CONFD for controlling an operation option of the driver circuit 310.

At least some of the plurality of unit data strings included in the setting control data CONFp may include blank control data HBC. The blank control data HBC may be data for controlling the supply period of the horizontal blank period data HBP. For example, the setting control data CONFp may include first blank control data HBC1, second blank control data HBC2, third blank control data HBC3, and fourth blank control data HBC4. As shown in FIG. 6, each of the blank control data HBC1, HBC2, HBC3, and HBC4 may include two blank control data HBC in one unit data string. One blank control data HBC may be included in one unit data string. In addition, the unit data string including the blank control data HBC1, HBC2, HBC3, and HBC4 may or may not be provided successively. After the setting control data CONF is provided, the pixel data PXD may be provided.

The pixel data PXD may include pixel grayscale data RGBD. The pixel data PXD may express a grayscale value of the pixel to which remaining bits D0, D1, D2, D3, D4, D5, D6, D7, and D8 correspond. After the pixel data PXD is provided, the horizontal blank period data HBP may be provided.

The horizontal blank period data HBP may inform the driver circuit 310 that a pixel row (for example, pixels connected to the same scan line) corresponding to the pixel data PXD is changed.

FIG. 8 is a diagram illustrating the horizontal blank period data of FIG. 4. In particular, FIG. 8 shows an example of horizontal blank period data HBPp provided to the same active line as the setting control data CONFp of FIG. 6. The horizontal blank period data HBPp may include a unit data string configured as 1110011000.

As described above, a supply period WHp of the horizontal blank period data HBPp may be set differently according to the blank control data HBC of the setting control data CONFp.

Further referring to FIG. 7, the blank control data HBC may be formed of four bits of data. In this case, the supply period of the horizontal blank period data HBP may be adjusted to 16 types according to values of the blank control data HBC1, HBC2, HBC3, and HBC4. In an embodiment, when the setting control data CONFp includes more bits of the blank control data HBC, the supply period of the horizontal blank period data HBP may be further divided and adjusted.

For example, when the blank control data HBC has data of 0000 in an order of the fourth blank control data HBC4, the third blank control data HBC3, the second blank control data HBC2, and the first blank control data HBC1, the horizontal blank period data HBPp may include 30 unit data strings. In this case, a period in which the horizontal blank period data HBPp is supplied may be 30 cycles 30T. At this time, the 30 cycles 30T may be a period in which 30 unit data are supplied. As another example, when the blank control data HBC has data of 1111, the horizontal blank period data HBPp may include 60 unit data strings. In this case, the period in which the horizontal blank period data HBPp is supplied may be 60 cycles 60T. The period WHp may be determined according to the values of the first blank control data HBC1, the second blank control data HBC2, the third blank control data HBC3, and the fourth blank control data HBC4 of the blank control data HBC.

The period in which the horizontal blank period data HBPp is supplied may be adjusted by the blank control data HBC of the setting control data CONFp. Periods in which the line image data LDCS1 to LDCSn are supplied may be adjusted according to the period in which the horizontal blank period data HBPp is supplied. For example, a third blank period WHb of the third horizontal blank period data HBPb may be set to be longer than a second blank period WHa of the second horizontal blank period data HBPa. Therefore, the period in which the third line image data LDCSb is supplied may be adjusted to be longer than the period in which the second line image data LDCSa is supplied.

Figure 9:
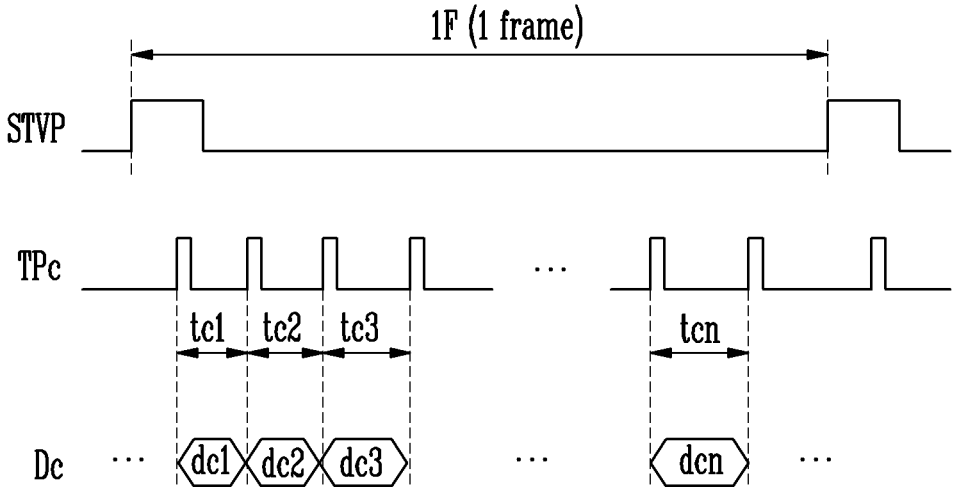
FIG. 9 is a diagram illustrating signals supplied to a third driver circuit of FIG. 2 and data signals supplied to a data line by the third driver circuit.
Figure 10:
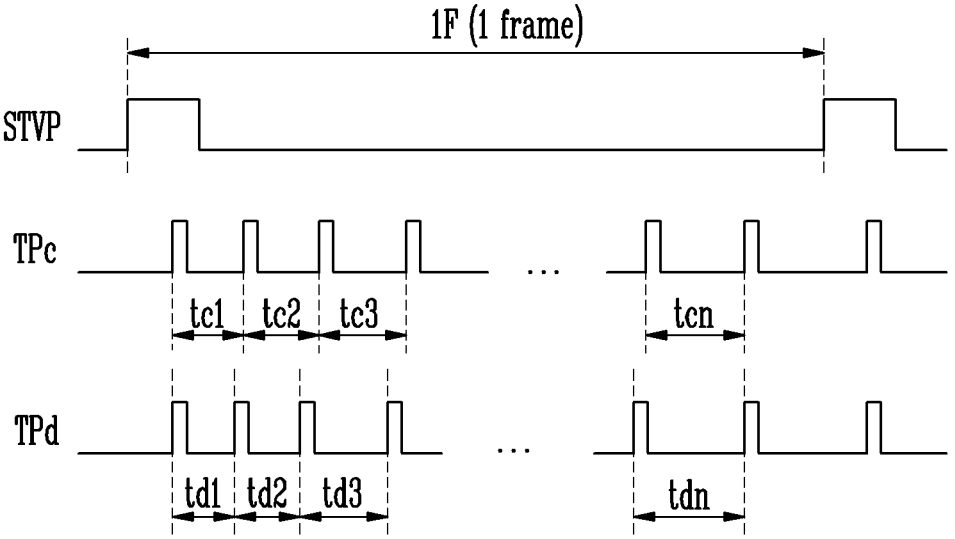
FIG. 10 is a diagram illustrating signals supplied to a second driver circuit and the third driver circuit of FIG. 2.

FIG. 9 is a diagram illustrating signals supplied to the third driver circuit of FIG. 2 and data signals supplied to the data line by the third driver circuit. FIG. 10 is a diagram illustrating signals supplied to the second driver circuit and the third driver circuit of FIG. 2.

Referring to FIGS. 1, 2, 9, and 10, the timing controller 400 may generate a scan start signal STVP and data load signals TPc and TPd.

The scan start signal STVP may be provided to the scan driver 200, and the scan driver 200 may provide the scan signals to the scan lines SL1 to SLn in correspondence with the scan start signal STVP. One frame may be started according to the scan start signal STVP, and a period between the scan start signals STVP may be a frame period 1F. The data load signals TPc and TPd may be signals provided to the data driver 300 through the data control line DCSL, and may be signals included in the data control signal DCS. The data load signals TPc and TPd may be signals including pulses of a high level, or may be pulses of a low level.

The driver circuit 310 of the data driver 300 may provide the data signal to the data lines in correspondence with the data load signal. For example, the second driver circuit 312 may provide the data signal to the data line group including the second data line DLc in correspondence with the first data load signal TPc, and the third driver circuit 313 may provide the data signal to the data line group including the third data line DLd in correspondence with the second data load signal TPd.

As shown in FIG. 9, the second driver circuit 312 may provide a data signal Dc to the data line group in correspondence with the first data load signal TPc, and the data signal Dc may be provided in a period corresponding to the first data load signal TPc provided to the second driver circuit 312. First to n-th data signals dc1 to dcn may be provided in correspondence with first to n-th data periods tc1 to tcn which are periods between pulses of the high level of the first data load signal TPc. For example, the first data signal dc1 may be provided during the first data period tc1, and the n-th data signal dcn may be provided during the n-th data period tcn.

In an embodiment, the periods in which the first to n-th data signals dc1 to dcn are supplied may be different from each other. For example, the periods in which the first to n-th data signals dc1 to dcn are supplied may gradually increase, and the pixel PX connected to the scan line farther from the driver circuit 312 may receive the data signal during a longer period.

A sum of the first to n-th data periods tc1 to tcn may be set within the frame period 1F. As described above, when the data period in which the data signal is supplied is set to be gradually increased, the first data period tc1 may be set to be shorter than a period in which the data signal is equally supplied to the pixels PX connected to the second driver circuit 312, and the n-th data period tcn may be set to be longer than the above-described period. For example, the frame period 1F may be 8.3 ms, the first data period tc1 may be 1.75 μs, and the n-th data period tcn may be 1.95 μs.

Further referring to FIG. 1, the periods of the data signals supplied to the first pixel PXac and the second pixel PXbc connected to the second data line DLc may be different from each other. The data signal may be supplied to the second pixel PXbc far from the data driver 300 for a period longer than a period in which the data signal is supplied to the first pixel PXac.

As the distance from the driver circuit 312 increases, an intensity of the data signal (or data voltage) provided through the data lines may decrease or a delay of the data signal may occur. Thus, a charge rate of the pixel PX far from the driver circuit 312 may decrease. As described above, the charge rate may refer to the charge rate of the storage capacitor Cst of FIG. 3A of the pixel PX. When the charge rate decreases, the amount of driving current flowing through the light emitting element LD of FIG. 3A may decrease, and the pixels PX may not emit light at a desired luminance. Therefore, an embodiment may sufficiently charge the pixels PX by providing the data signal to the pixel PX far from the driver circuit 312 during a period longer than a period in which the data signal is provided to the pixel close to the driver circuit 312. Therefore, the pixels PX may emit light at a desired luminance.

Meanwhile, as shown in FIG. 10, the first data load signal TPc provided to the second driver circuit 312 and the second data load signal TPd provided to the third driver circuit 313 may be different from each other.

The data lines connected to the third driver circuit 313 may be farther from the scan driver 200 than the data lines connected to the second driver circuit 312. As the distance from the scan driver 200 increases, an intensity of the scan signal provided through the scan lines may decrease or a waveform of the scan signal may change. Thus, a charge rate of the pixels PX far from the scan driver 200 may decrease. Therefore, a difference of the charge rates between the pixels PX connected to the third driver circuit 313 may be greater than a difference of the charge rates between the pixels PX connected to the second driver circuit 312. For example, in FIG. 1, a difference of charge rates of the third pixel PXad and the fourth pixel PXbd farther from the scan driver 200 may be greater than a difference of charge rates of the first pixel PXac and the second pixel PXbc.

Therefore, a difference between the data periods supplied to the third driver circuit 313 may be set to be greater than a difference between the data periods supplied to the second driver circuit 312. That is, a first data period td1 of the second data load signal may be set to be shorter than the first data period tc1 of the first data load signal TPc, and an n-th data period tdn of the second data load signal may be set to be longer than the n-th data period tcn of the first data load signal TPc. For example, the first data period td1 may be 1.35 ms, and the n-th data period tdn may be 2.35 μs.

That is, when the data signal supply periods of the first to fourth pixels PXac, PXbc, PXad, and PXbd are compared, the supply period of the data signal supplied to the fourth pixel PXbd is longest, and the supply periods of the data signals may be longer in an order of the second pixel PXbc, the first pixel PXac, and the third pixel PXad.

The display device 10 of the disclosure may adjust the period in which the data signal is supplied in correspondence with the difference of the charge rate generated according to the distance between the pixels PX and the data driver 300. In addition, the display device 10 of the disclosure may adjust the period of the data signal supplied by each driver circuit 310 in correspondence with the difference of the charge rate generated by the distance between the pixels PX and the scan driver 200. Therefore, a luminance may be improved by securing the charge rate of the pixels PX far from each of the drivers 200 and 300, and a noise defect due to a charge rate abnormality may be improved.

The supply period of the data signal described above may be formed through the data control signal DCS provided by the timing controller 400. The setting control data CONF of the data control signal DCS provided in the active data period may include the blank control data HBC. Therefore, the period in which the horizontal blank period data HBP is supplied may be adjusted, and the period in which the data driver 300 supplies the data signal to the pixels PX may be adjusted.

Hereinafter, an embodiment of the display device will be described. In the following embodiment, the same configuration as the previously described embodiment will be referred to by the same reference numerals, the description thereof will be omitted or simplified, and a difference will be mainly described.

Figure 11:
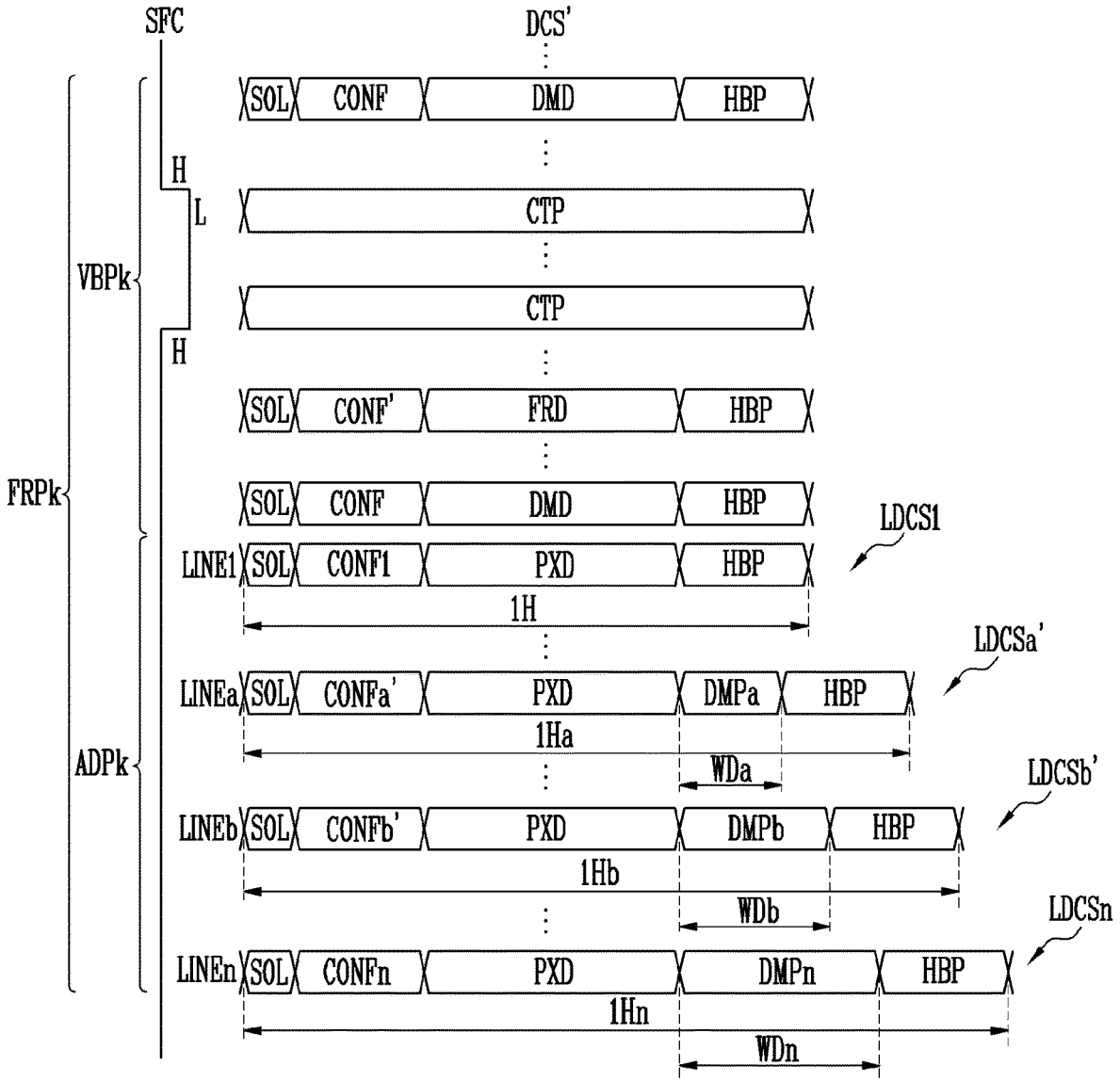
FIG. 11 is a diagram illustrating a signal provided to a data driver by a timing controller during one frame according to an embodiment of the disclosure.
Figure 12:
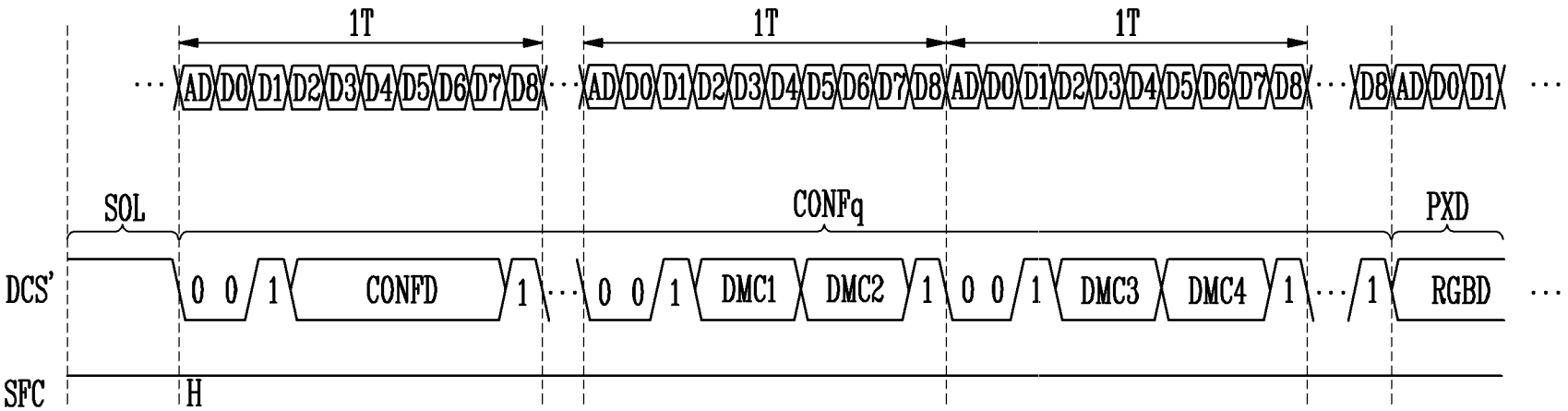
FIG. 12 is a diagram illustrating setting control data of FIG. 11.

FIG. 11 is a diagram illustrating a signal provided to a data driver by a timing controller during one frame according to an embodiment of the disclosure. FIG. 12 is a diagram illustrating setting control data of FIG. 11. FIG. 13 is a diagram illustrating an output period of dummy data according to dummy control data of FIG. 12.

Referring to FIGS. 11 to 13, the data control signal DCS' may include line image data LDCS1 to LDCSn provided in the active data period ADPk. At least some of the line image data LDCS1 to LDCSn may include dummy data DMPa, DMPb, and DMPn supplied between the pixel data PXD and the horizontal blank period data HBP. The dummy data DMPa, DMPb, and DMPn may be data that does not include information for controlling the data signal.

The second line image data LDCSa' may include second setting control data CONFa' and second dummy data DMPa. The second dummy data DMPa may be supplied during a first dummy period WDa. In addition, the third line image data LDCSb' may include third setting control data CONFb' and third dummy data DMPb. The third dummy data DMPb may be supplied during a second dummy period WDb. The periods in which the dummy data DMPa, DMPb, and DMPn are supplied may be adjusted by setting control data CONFa', CONFb', and CONFn.

As shown in FIG. 12, at least some of a plurality of unit data strings included in setting control data CONFq may include dummy control data DMC1, DMC2, DMC3, and DMC4. The dummy control data DMC1, DMC2, DMC3, and DMC4 may be data for controlling the supply period of the dummy data DMPa, DMPb, and DMPn. For example, the setting control data CONFq may include the first dummy control data DMC1, the second dummy control data DMC2, the third dummy control data DMC3, and the fourth dummy control data DMC4. Each of the dummy control data DMC1, DMC2, DMC3, and DMC4 may include two dummy control data in one unit data string, as shown in FIG. 12, or may include one dummy control data may be included in one unit data string. In addition, the unit data string including the dummy control data DMC1, DMC2, DMC3, and DMC4 may or may not be provided successively.

Further referring to FIG. 13, the dummy control data DMC may be formed of four bits of data. In this case, the supply period of the dummy data DMPa, DMPb, and DMPn may be adjusted to 16 types according to values of the dummy control data DMC1, DMC2, DMC3, and DMC4. In an embodiment, and when the setting control data CONFq includes more bits of dummy control data, the supply period of the dummy data DMPa, DMPb, and DMPn may be further divided and adjusted.

For example, the dummy control data DMC1, DMC2, DMC3, and DMC4 have data of 0000 in an order of the fourth dummy control data DMC4, the third dummy control data DMC3, the second dummy control data DMC2, and the first dummy control data, the line image data may not include dummy data. As another example, when the dummy control data DMC1, DMC2, DMC3, and DMC4 have data configured as 1111, the dummy data may include 60 unit data strings. In this case, the period in which the dummy data is supplied may be 60 cycles 60T. As described above, the period in which the dummy data DMPa, DMPb, and DMPn of the line image data LDCS1 to LDCSn are supplied may be determined according to the values of the first dummy control data DMC1, the second dummy control data DMC2, the third dummy control data DMC3, and the fourth dummy control data DMC4 of the dummy control data DMC.

According to the period in which the dummy data DMPa, DMPb, and DMPn are supplied, the period in which the line image data LDCS1 to LDCSn are supplied may be adjusted. For example, the second dummy period WDb of the third dummy data DMPb may be set to be longer than the first dummy period WDa of the second dummy data DMPa. Therefore, the period in which the third line image data LDCSb' is supplied may be adjusted to be longer than the period in which the second line image data LDCSa' is supplied.

Although the embodiments of the disclosure have been described with reference to the accompanying drawings, it will be understood by those skilled in the art, in light of the disclosure, that the embodiments may be implemented in other forms without changing the technical spirit and essential features of the disclosure. Therefore, the embodiments described above are illustrative and are not restrictive in all aspects.

What is claimed is:

1. A display device comprising:

a first pixel connected to a first scan line and a first data line;

a second pixel connected to a second scan line and the first data line;

a third pixel connected to the first scan line and a second data line;

a fourth pixel connected to the second scan line and the second data line, a scan driver configured to supply a scan signal to the first scan line and the second scan line;

a data driver connected to the first data line and the second data line; and a timing controller configured to provide a data control signal to the data driver, wherein the data driver provides a first data signal to the first pixel when the scan signal is applied to the first scan line, wherein the data driver provides a third data signal to the third pixel when the scan signal is applied to the first scan line, wherein the data driver provides a fourth data signal to the fourth pixel when the scan signal is applied to the second scan line, wherein the data driver provides a second data signal to the second pixel when the scan signal is applied to the second scan line, wherein a length of a first period in which the first data signal is provided is different from a length of a second period in which the second data signal is provided, wherein the data control signal comprises line image data respectively corresponding to the first scan line and the second scan line, wherein each of the line image data comprises line start data, setting control data, pixel data, and horizontal blank period data, wherein the timing controller controls the setting control data to adjust a supply period of each of the line image data, wherein the second scan line is positioned between the first scan line and the data driver, wherein the second data line is positioned between the first data line and the scan driver, wherein the horizontal blank period data includes first horizontal blank period data corresponding to the first pixel and second horizontal blank period data corresponding to the second pixel, wherein a period in which the first horizontal blank period data is supplied is longer than a period in which the second horizontal blank period data is supplied, and wherein a length of a fourth period in which the fourth data signal is provided is longer than the length of the second period.

2. The display device according to claim 1, wherein the length of the first period is longer than the length of the second period.

3. The display device according to claim 2, wherein the setting control data comprises blank control data for controlling a period in which the horizontal blank period data is supplied to the data driver.

4. The display device according to claim 3, wherein first line image data corresponding to the first pixel comprises the first horizontal blank period data, wherein second line image data corresponding to the second pixel comprises the second horizontal blank period data.

5. The display device according to claim 2, wherein a period in which the line image data is supplied to the data driver increases as a period in which the horizontal blank period data is supplied to the data driver increases.

6. The display device according to claim 2, wherein the data driver provides the third data signal to the third pixel through the second data line, and wherein a length of a third period in which the third data signal is provided is shorter than the length of the first period.

7. The display device according to claim 6, wherein the data driver provides the fourth data signal to the fourth pixel through the second data line.

8. The display device according to claim 7, wherein the length of the third period is longer than the length of the fourth period.

9. The display device according to claim 6, wherein the data driver comprises a plurality of driver circuits, and wherein the first data line and the second data line are connected to different driver circuits.

10. A display device comprising:

a first pixel connected to a first scan line and a first data line;

a second pixel connected to a second scan line and the first data line;

a third pixel connected to the first scan line and a second data line;

a fourth pixel connected to the second scan line and the second data line, a scan driver configured to supply a scan signal to the first scan line and the second scan line;

a data driver connected to the first data line and the second data line; and a timing controller configured to provide a data control signal to the data driver, wherein the data driver provides a first data signal to the first pixel when the scan signal is applied to the first scan line, wherein the data driver provides a second data signal to the second pixel when the scan signal is applied to the second scan line, wherein the data driver provides a third data signal to the third pixel when the scan signal is applied to the first scan line, wherein the data driver provides a fourth data signal to the fourth pixel when the scan signal is applied to the second scan line, wherein a length of a first period in which the first data signal is provided is different from a length of a second period in which the second data signal is provided, wherein the data control signal comprises line image data respectively corresponding to the first scan line and the second scan line, wherein each of the line image data comprises line start data, setting control data, pixel data, dummy data, and horizontal blank period data, wherein the timing controller controls the setting control data to adjust a supply period of each of the line image data, wherein the dummy data is provided between the pixel data and the horizontal blank period data, wherein the second scan line is positioned between the first scan line and the data driver, wherein the second data line is positioned between the first data line and the scan driver, wherein the dummy data includes first dummy data corresponding to the first pixel and second dummy data corresponding to the second pixel, wherein a period in which the first dummy data is supplied is longer than a period in which the second dummy data is supplied, and wherein a length of a fourth period in which the fourth data signal is provided is longer than the length of the second period.

11. The display device according to claim 10, wherein the setting control data comprises dummy control data for controlling a period in which the dummy data is supplied to the data driver.

12. The display device according to claim 11, wherein first line image data corresponding to the first pixel comprises the first dummy data, second line image data corresponding to the second pixel comprises the second dummy data, wherein a period in which the first dummy data is supplied is longer than a period in which the second dummy data is supplied, and wherein the length of the first period is longer than the length of the second period.

13. The display device according to claim 10, wherein a period in which the line image data is supplied to the data driver increases as a period in which the dummy data is supplied to the data driver increases.

14. A display device comprising:

a scan driver comprising scan lines;

a data driver comprising data lines;

a timing controller configured to provide a data control signal to the data driver; and pixels connected to respective ones of the scan lines and respective ones of the data lines, wherein the pixels include a first pixel connected to a first scan line and a first data line, and a second pixel connected to a second scan line and the first data line, wherein the data driver provides data signals to the pixels through the respective ones of the data lines, wherein a period in which the data signals are supplied to the pixels increases as a distance from the data driver increases, wherein the data control signal comprises line image data respectively corresponding to the scan lines, wherein each of the line image data comprises line start data, setting control data, pixel data, and horizontal blank period data, wherein the timing controller controls the setting control data to adjust a supply period of each of the line image data, wherein the second scan line is positioned between the first scan line and the data driver, wherein the horizontal blank period data includes first horizontal blank period data corresponding to the first pixel and second horizontal blank period data corresponding to the second pixel, wherein a period in which the first horizontal blank period data is supplied is longer than a period in which the second horizontal blank period data is supplied, wherein the data control signal comprises at least a first data load signal and a second data load signal to the data driver, and wherein a first data period of the second data load signal is shorter than a first data period of the first data load signal, and wherein an n-th data period of the second data load signal is longer than an n-th data period of the first data load signal.

15. The display device according to claim 14, wherein the setting control data comprises blank control data for controlling a period in which the horizontal blank period data is supplied to the data driver.

16. The display device according to claim 15, wherein a period in which the line image data is supplied increases as a period in which the horizontal blank period data is supplied increases.

17. The display device according to claim 14, wherein each of the line image data further comprises dummy data, wherein the dummy data is provided between the pixel data and the horizontal blank period data, and wherein the setting control data comprises dummy control data for controlling a period in which the dummy data is supplied to the data driver.

18. The display device according to claim 17, wherein a period in which the line image data is supplied increases as a period in which the dummy data is supplied increases.

* * * * *